US005134567A

United States Patent [19]

Haug

[11] Patent Number: 5,134,567

[45] Date of Patent: Jul. 28, 1992

[54] FRANKING MACHINE

[75] Inventor: Werner Haug, Langnau, Switzerland

[73] Assignee: Frama AG, Lauperswil, Switzerland

[21] Appl. No.: 490,037

[22] Filed: Mar. 7, 1990

[30] Foreign Application Priority Data

Mar. 8, 1989 [CH] Switzerland ..... 00854/89

[51] Int. Cl.[5] ..... G07B 17/00

[52] U.S. Cl. ..... 364/464.02

[58] Field of Search ..... 177/25.15; 364/464.02, 364/464.03, 709.01, 709.15, 709.16

[56] References Cited

U.S. PATENT DOCUMENTS

| | | | |
|---|---|---|---|
| 4,097,923 | 6/1978 | Eckert, Jr. et al. | 364/900 |
| 4,120,040 | 10/1978 | Aihara | 364/709.15 |
| 4,495,581 | 1/1985 | Piccione | 177/25.15 X |
| 4,499,545 | 2/1985 | Daniels et al. | 364/464.02 |
| 4,520,725 | 6/1985 | Haug | 101/110 X |
| 4,731,728 | 3/1988 | Muller | 364/464.02 X |
| 4,788,623 | 11/1988 | Haug | 361/171 |
| 4,814,995 | 3/1989 | Daniels, Jr. | 364/464.02 |
| 4,898,093 | 2/1990 | Haug | 101/110 X |
| 4,901,241 | 2/1990 | Schneck | 364/464.02 |
| 4,947,333 | 8/1990 | Sansone et al. | 364/464.03 X |

*Primary Examiner*—Parshotham S. Lall
*Assistant Examiner*—Edward R. Cosimano
*Attorney, Agent, or Firm*—Ladas & Parry

[57] ABSTRACT

The franking machine has a control console (50) on which is provided a number of keys (21–24) corresponding to the decimal places of a maximum franking value amount. The most frequently occurring franking value amounts and also surcharge amounts for special letter despatch types are predetermined in fixed manner by programming a control unit of the franking machine and are associated with the said keys (21–24) and additional keys (25, AIR, EXP, REG) so that the entry of a complete franking value amount by pressing a single key is possible. The franking machine can be switched between two entry modes by a special key (D-SET) and these modes are performed by means of the same keys (21–24). If exceptionally a franking value amount is to be entered in the franking machine and which does not correspond to one of the fixed, predetermined franking value amounts, entry takes place after operating the switching special key (D-SET) separately by stepwise entry via the keys (21–24) associated with these decimal places.

4 Claims, 10 Drawing Sheets

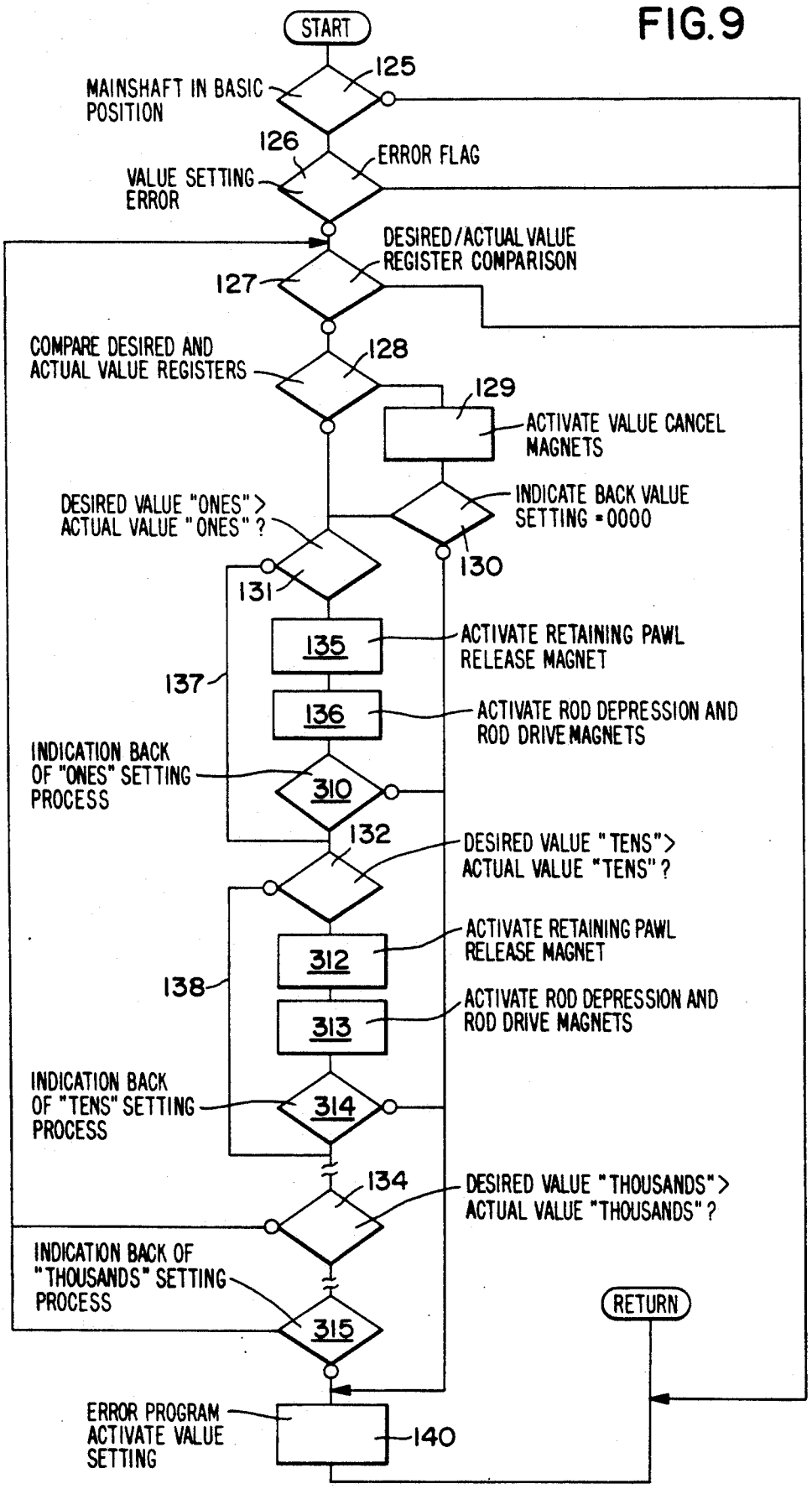
FIG.9
START
125
MAINSHAFT IN BASIC POSITION
126
ERROR FLAG
VALUE SETTING ERROR
DESIRED/ACTUAL VALUE REGISTER COMPARISON
127
COMPARE DESIRED AND ACTUAL VALUE REGISTERS
128
129
ACTIVATE VALUE CANCEL MAGNETS
INDICATE BACK VALUE SETTING = 0000
DESIRED VALUE "ONES" > ACTUAL VALUE "ONES" ?
130
131
135
ACTIVATE RETAINING PAWL RELEASE MAGNET
137
136
ACTIVATE ROD DEPRESSION AND ROD DRIVE MAGNETS
INDICATION BACK OF "ONES" SETTING PROCESS
310
132
DESIRED VALUE "TENS" > ACTUAL VALUE "TENS" ?
312
ACTIVATE RETAINING PAWL RELEASE MAGNET
138
313
ACTIVATE ROD DEPRESSION AND ROD DRIVE MAGNETS
INDICATION BACK OF "TENS" SETTING PROCESS
314
134
DESIRED VALUE "THOUSANDS" > ACTUAL VALUE "THOUSANDS" ?
INDICATION BACK OF "THOUSANDS" SETTING PROCESS
315
RETURN
ERROR PROGRAM ACTIVATE VALUE SETTING
140

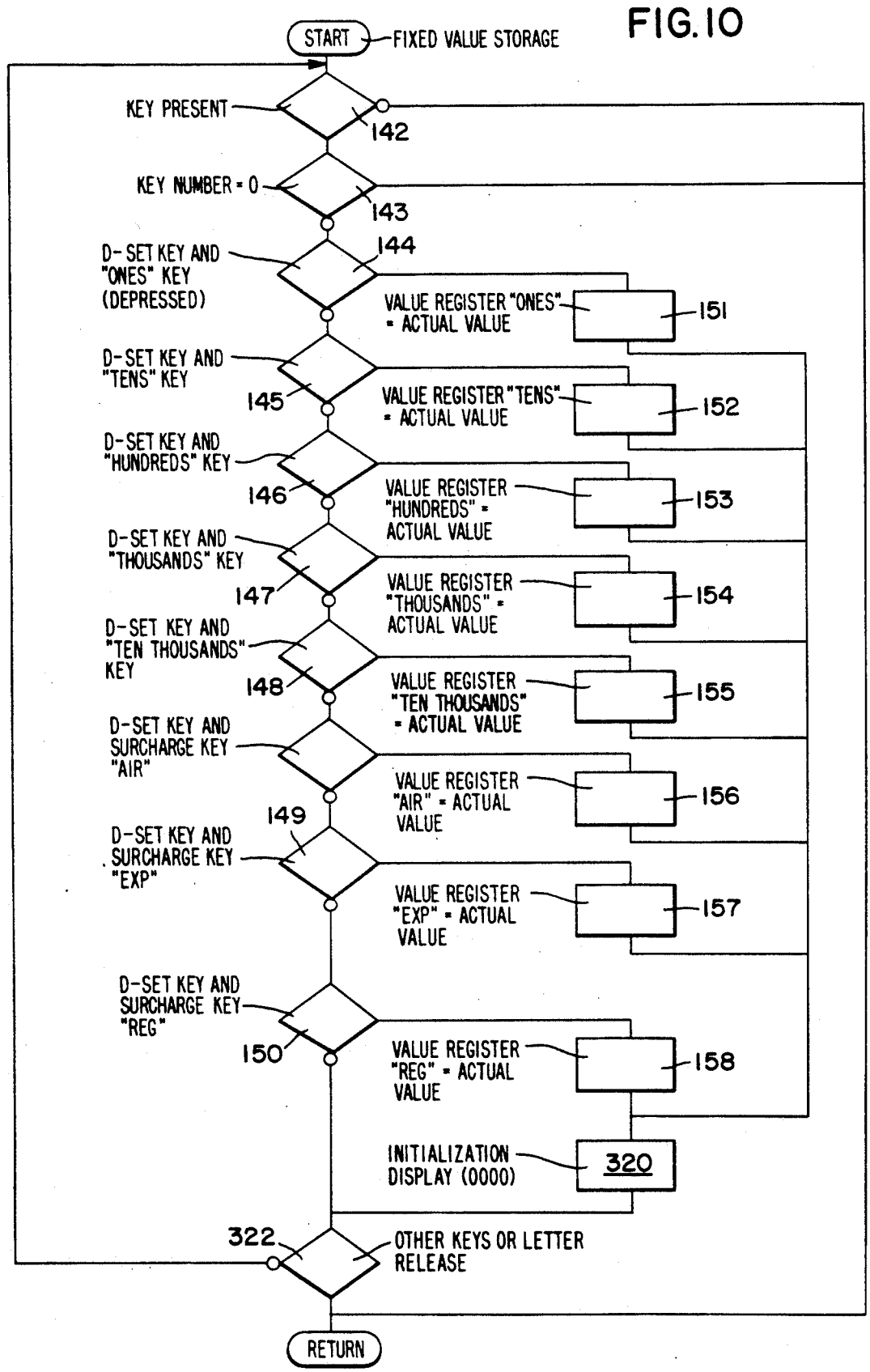
FIG.10
START
FIXED VALUE STORAGE
KEY PRESENT
142
KEY NUMBER = 0
143
D-SET KEY AND "ONES" KEY (DEPRESSED)
144
VALUE REGISTER "ONES" = ACTUAL VALUE
151
D-SET KEY AND "TENS" KEY
145
VALUE REGISTER "TENS" = ACTUAL VALUE
152
D-SET KEY AND "HUNDREDS" KEY
146
VALUE REGISTER "HUNDREDS" = ACTUAL VALUE
153
D-SET KEY AND "THOUSANDS" KEY
147
VALUE REGISTER "THOUSANDS" = ACTUAL VALUE
154
D-SET KEY AND "TEN THOUSANDS" KEY
148
VALUE REGISTER "TEN THOUSANDS" = ACTUAL VALUE
155
D-SET KEY AND SURCHARGE KEY "AIR"
VALUE REGISTER "AIR" = ACTUAL VALUE
156
149
D-SET KEY AND SURCHARGE KEY "EXP"
VALUE REGISTER "EXP" = ACTUAL VALUE
157
D-SET KEY AND SURCHARGE KEY "REG"
150
VALUE REGISTER "REG" = ACTUAL VALUE
158
INITIALIZATION DISPLAY (0000)
320
322
OTHER KEYS OR LETTER RELEASE
RETURN

FRANKING MACHINE

BACKGROUND OF THE INVENTION

The invention relates to a franking machine with a printing head fixed to a machine mainshaft, a drive for the machine mainshaft, in order to rotate the printing head for at least one printing cycle, typewheels mounted in rotary manner in the printing head for printing the value, an electromechanical drive for each of the typewheels for setting a desired franking value, mechanical locking means for securing the setting positions of control members of the electromechanical drive, sensors for supplying position signals of the locking means to a central electronic control unit for the control of the electromechanical drive and a control console with a keyboard for the random inputting of instructions to the control unit for setting the typewheels of the printing head and with a display for displaying the inputted instructions.

In a known franking machine of this type (U.S. Pat. No. 4,097,923), the instructions to an electronic control unit for setting the franking value are only inputted via a tens keyboard. The electromechanical setting of the typewheels takes place at the end of the complete entry by means of an additional actuating signal. For setting a three-figure franking value of e.g. $1.00, three instructions are inputted for this figure sequence and also an actuating instruction (SET) via the keyboard, so that in all it is necessary to press four keys.

SUMMARY OF THE INVENTION

The problem of the invention is to provide a franking machine of the aforementioned type, which is more simply and rapidly operable for setting the typewheels to a desired franking value amount. According to the invention, this problem is solved in that an instruction key (D-SET) is provided for programming the central electronic control unit in such a way that a predetermined franking value amount is associated with at least one entry key provided on the control console, said entry key also being a cancel key for the amount which can be entered by it, so that as a result of the operation thereof, following the entry actuation, the entered additional amount is deducted from the total amount of the entry.

The predetermined franking value amount can e.g. be a frequently occurring basic franking amount, but also a surcharge or extra amount, which for special despatch types, such as e.g. Express, is added to the basic amount set by one or more other keys in the computer to the central electronic control unit. In this case a surcharge key is available on the control console for this random surcharge amount, which can be programmed in by the franking machine user.

The association of predetermined franking value amounts can also take place with entry keys provided for entering the figures and which are e.g. entry keys of a decimal or tens keyboard, so that these entry keys can be switched e.g. by means of the said instruction key between two operating modes, i.e. between the entry of individual figures of a franking value amount and the entry of predetermined franking value amounts.

A decimal keyboard has the advantage that for the entry of random franking value amounts up to a maximum amount, it is only necessary to provide a number of keys corresponding to the decimal places of the maximum franking value amount. Entry takes place by a multiple or cyclic operation of the particular decimal key. For setting franking value amounts with a maximum of four figures, there are consequently only four keys on the control console, whereas with a tens keyboard ten keys are required for this.

A significant simplification of operation is obtained if four franking value amounts which are most frequently required are associated in fixed manner with the four keys of a decimal keyboard, so that the setting of multiple-place franking value amounts can take place by a single operation of only one key. The fifth key, i.e. the instruction key (D-SET) is consequently only to be operated for changeover, i.e. in exceptional cases and if a not frequently required franking value amount has to be set. However, even in this case the number of the necessary multiple key movements is only greater than in a known machine if it is necessary to set a figure higher than 4. As will be discussed hereinafter, after pressing the D-SET key, the franking value is established by cycling through individual digits of the value display. However, when any value key is, instead, pressed without pressing the D-SET key, then a fixed value associated with that value key is selected. The D-SET is also used for programming each value key to set such key to a desired fixed value.

An additional actuating key for a previously entered value quantity can be avoided, so that adjusting of the typewheels takes place without delay during the entry of the instructions via the decimal keyboard, in that the control unit supplies control instructions without delay to the electro-mechanical drives, before the complete franking value amount to be printed by the printing head has been entered via the keyboard. At the end of the entry operation, the setting on the printing head is already complete and franking can immediately take place.

The keys, whose number corresponds to the number of decimal places of a maximum franking amount, are preferably so arranged on the display that each key is spatially associated with that part of the display on which the decimal place to be set by it appears in the case of cyclic entry.

According to a further development of the invention, the entry via the surcharge keys can be cancelled out by operating them again, without the previously set basic amount having to be entered again. This is possible by subdividing the entry over two entry keys. The setting on the printing head must admittedly be automatically reset to zero, but the repetition of the setting of the basic amount takes place automatically, because this amount is retained in the memory of the central control unit.

Preferably the switching on of the surcharge keys is indicated by light-emitting diodes positioned alongside them. This display is only extinguished after a further operation of the corresponding surcharge key and simultaneously the previously entered surcharge amount is subtracted from the amount set in the printing head. This process also appears in the display, which displays the particular amount set in the printing head.

Moreover, on operating the keys for the direct entry of a basic franking amount according to the microprocessor programme, there is an automatic cancellation of the preceding amount, including an amount entered by means of a surcharge key, as well as its associated light-emitting diode, so that the prior operation of a cancel key is not necessary. Thus, if an incorrect key was pressed, during the subsequent pressing of the correct key there would be an immediate correction of this incorrect operation.

An additionally provided cancel key (CE) is consequently only necessary if the typewheels on the printing head and the corresponding display on the display means are to be set to zero. This can e.g. be desired for carrying out a check printing of the printing head or establishing the date set on the franking head and without consuming value quantities stored in the machine.

BRIEF DESCRIPTION OF THE DRAWINGS

Advantageous embodiments of the invention are described in greater detail hereinafter relative to the drawings, wherein show:

FIG. 9—A flowchart for representing the programme sequence of the electronic control unit on setting the value of the typewheels on the basis of the preceding value entry.

FIG. 10—A flowchart of the programming of the electronic control unit for the association of predetermined value quantity amounts with entry keys.

DETAILED DESCRIPTION OF THE INVENTION

A franking machine of the type on which the invention is based and in particular the locking means for securing the setting positions and for preventing wrong settings is e.g. known from Swiss patent 669 056 (U.S. Pat. No. 89,093) and is described in detail therein. The operation of the electromechanical drive of the typewheels is also described in U.S. Pat. No. 4,520,725. Therefore the following description is limited, whilst referring to and incorporating herein these prior publications to the essential part of the machine mechanism necessary for the understanding of the present invention.

Figure 1:
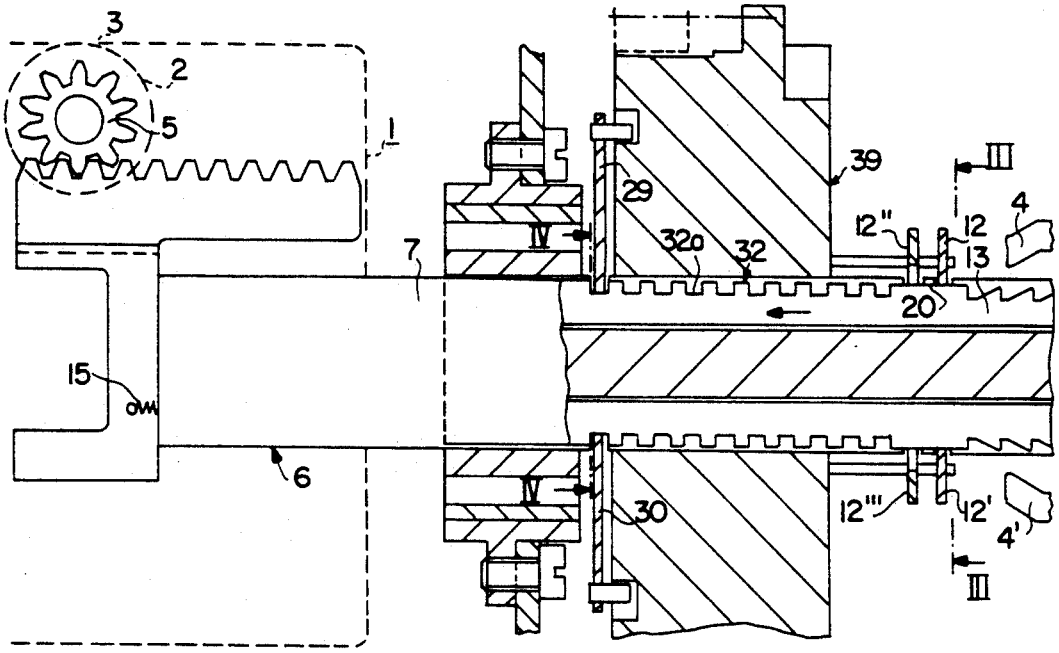
FIG. 1—A partial view of the franking machine in the form of a section along its mainshaft.

In FIG. 1, typewheels 2 mounted in the franking head 1 and whereof one is provided for each decimal place of the value amount to be printed, carry on their circumference the FIGS. 0–9. The setting of a specific figure takes place by the stepwise rotation starting from the zero position.

Figure 6:
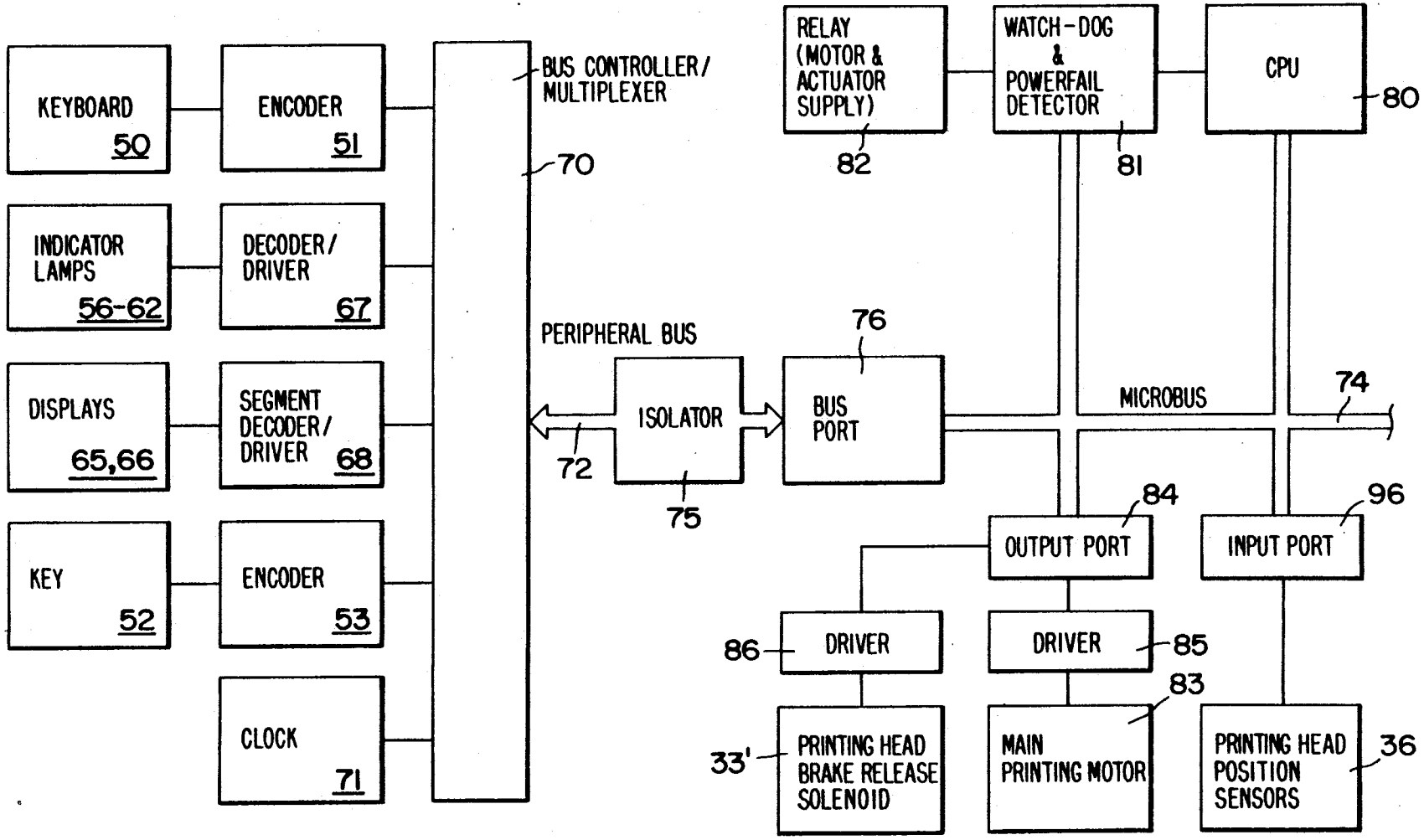
FIG. 6—A first half of a simplified block diagram of the central control unit of the franking machine.
Figure 7:
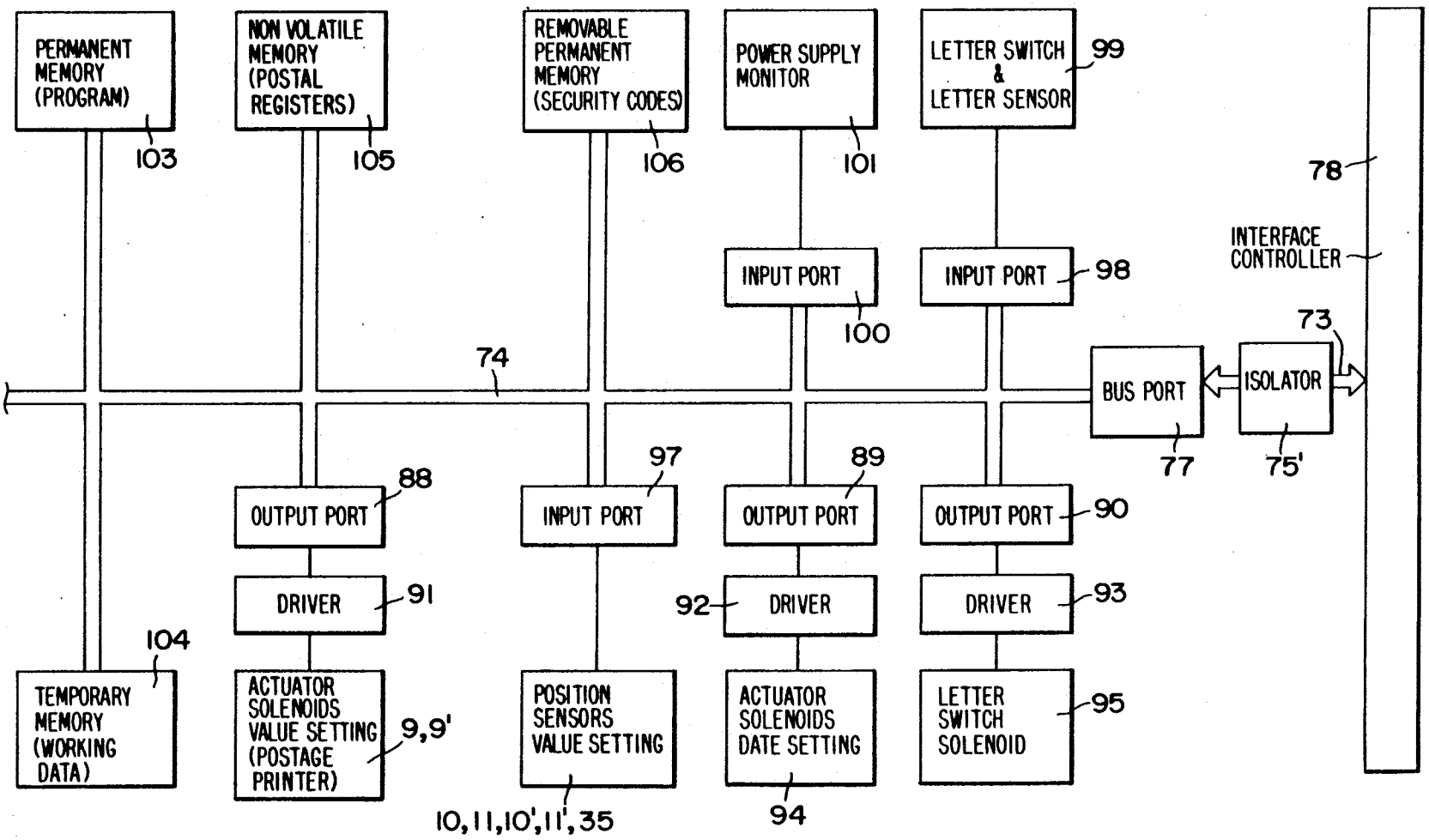
FIG. 7—The second half of the block diagram of FIG. 6.

In order e.g. to move the FIG. "4" of typewheel 2 of a decimal place into the printing position on the circumference 3 of the printing head, a drive rod 4, 4' provided for the particular decimal place, four times carries out a picking engagement motion and a percussive motion, so that the rack 7 guided in the machine mainshaft 6 and constantly engaged with the pinion 5 is correspondingly stepwise shifted counter to the tension of a tension spring 15. Two solenoids 9 are provided for these movements of the drive rod 4 and they receive their electric pulses from a central control unit (FIGS. 6 and 7).

Figure 3:
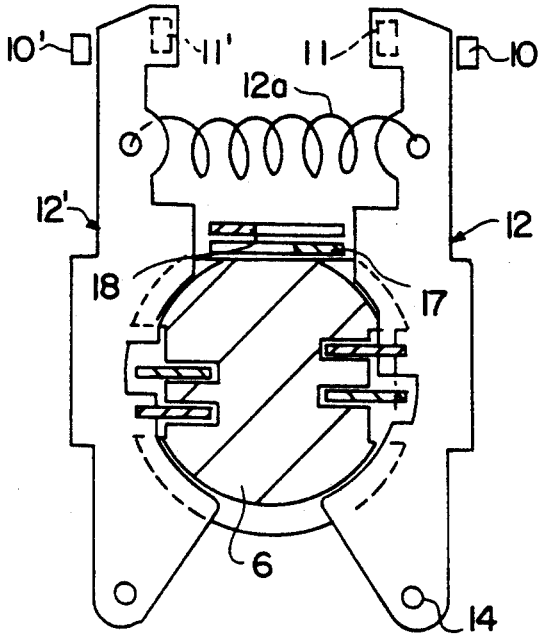
FIG. 3—A cross-section through the machine mainshaft along line III—III in FIG. 1.

The stepwise rack movement is checked by a back-indication to the control unit by means of optical sensors 10, 11 (FIG. 3). The latter are located in the movement path of a detent 12 which, through its resilient engagement with a drive tooth system 13 of the particular rack 7, is pivoted during each further movement by one tooth and therefore during each setting of a following figure of the typewheel 2 about a spindle 14. As a result of its engagement, detent 12 also ensures that the rack 7 does not unintentionally move back into the detent starting position as a result of the tension of its return spring 12*a*.

Figure 2:
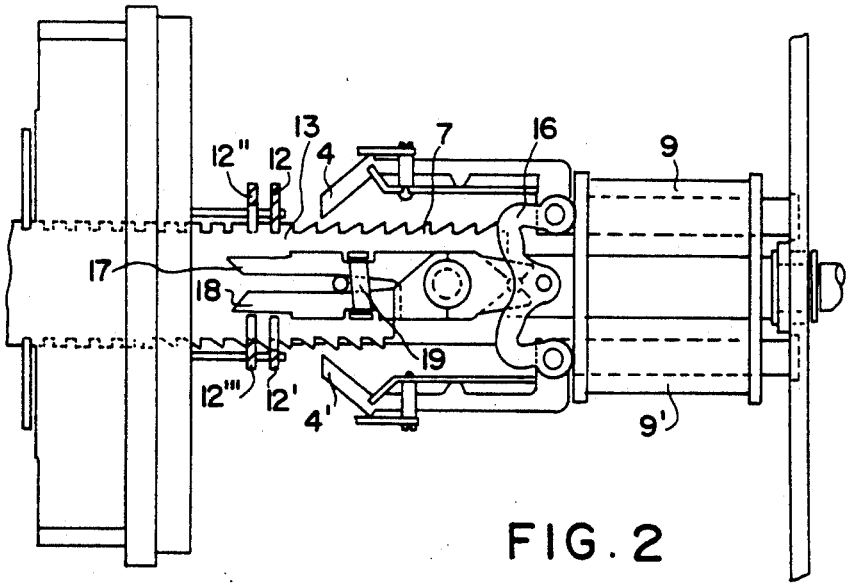
FIG. 2—A partial view of the franking machine, at right angles to its mainshaft in the vicinity of the adjusting rod for the franking value settings, with a mechanism for cancelling all the value settings.

It is obvious that the described mechanism must be present four times for each value figure typewheel and for four decimal places. FIG. 2 shows four of the said detents 12, 12', 12'', 12'''.

The resetting to zero of the value set on the typewheels 2, e.g. if the cancel key CE on the control console (FIG. 5) is pressed, or is pressed again for correcting a value entry key (21–25) on the control console, takes place in that two parallel acting drive magnets 9, 9' are simultaneously energized as a result of corresponding control signals of the control unit (FIGS. 6 and 7), so that, via bow-shaped member 16, they jointly spread apart in scissor-like manner to release catches 17, 18 mounted between the detents 12, 12', 12'', 12''' counter to the tension of a spring 19 (FIG. 2) and consequently disengage said detents. Thus, the tension spring 15 draws the racks 7 back into their starting or zero position and consequently the typewheels 2 are turned back into their zero position.

The back-indication of the zero positions to the central control unit (FIGS. 6 and 7) also takes place by means of the sensors 10, 11; 10', 11', because the detents 12, 12', 12'', 12''' in the corresponding position of the four racks 7 are located in the outwardly pivoted position on an untoothed, raised part 20 of the rack, as shown in FIG. 1.

Figure 4:
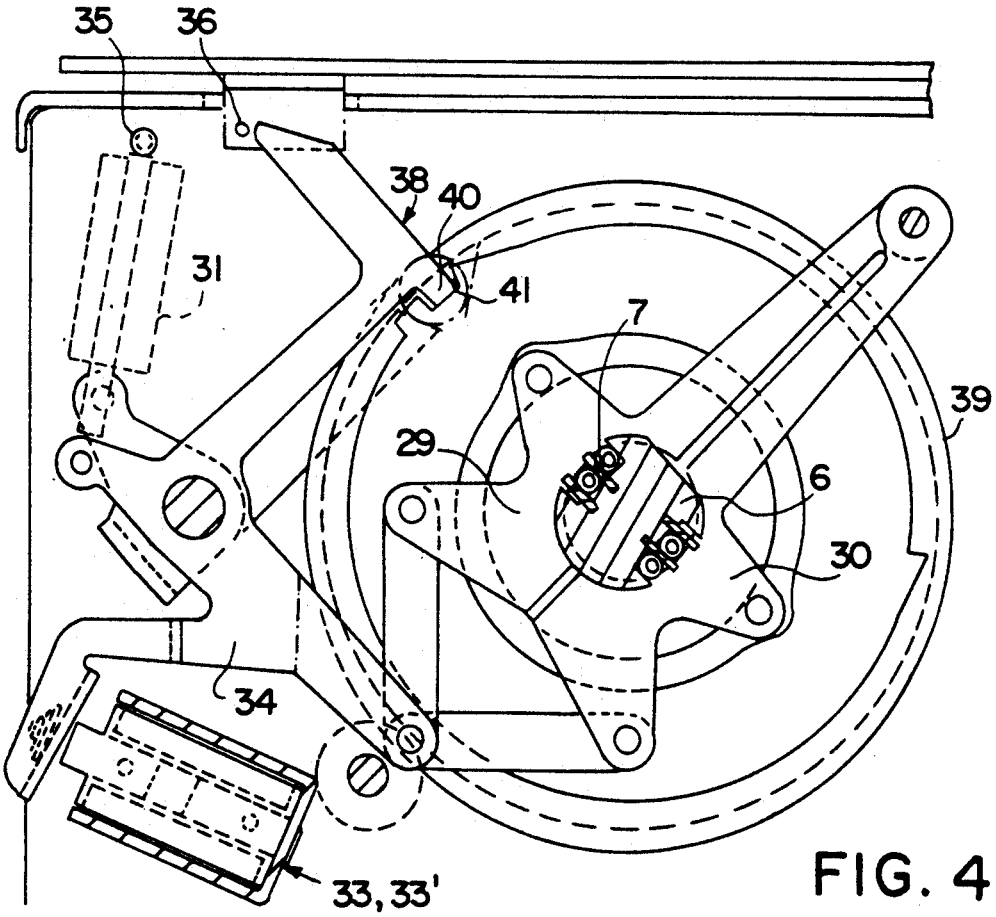
FIG. 4—A view of a retaining pawl mechanism with a section along line IV—IV in FIG. 1.
Figure 5:
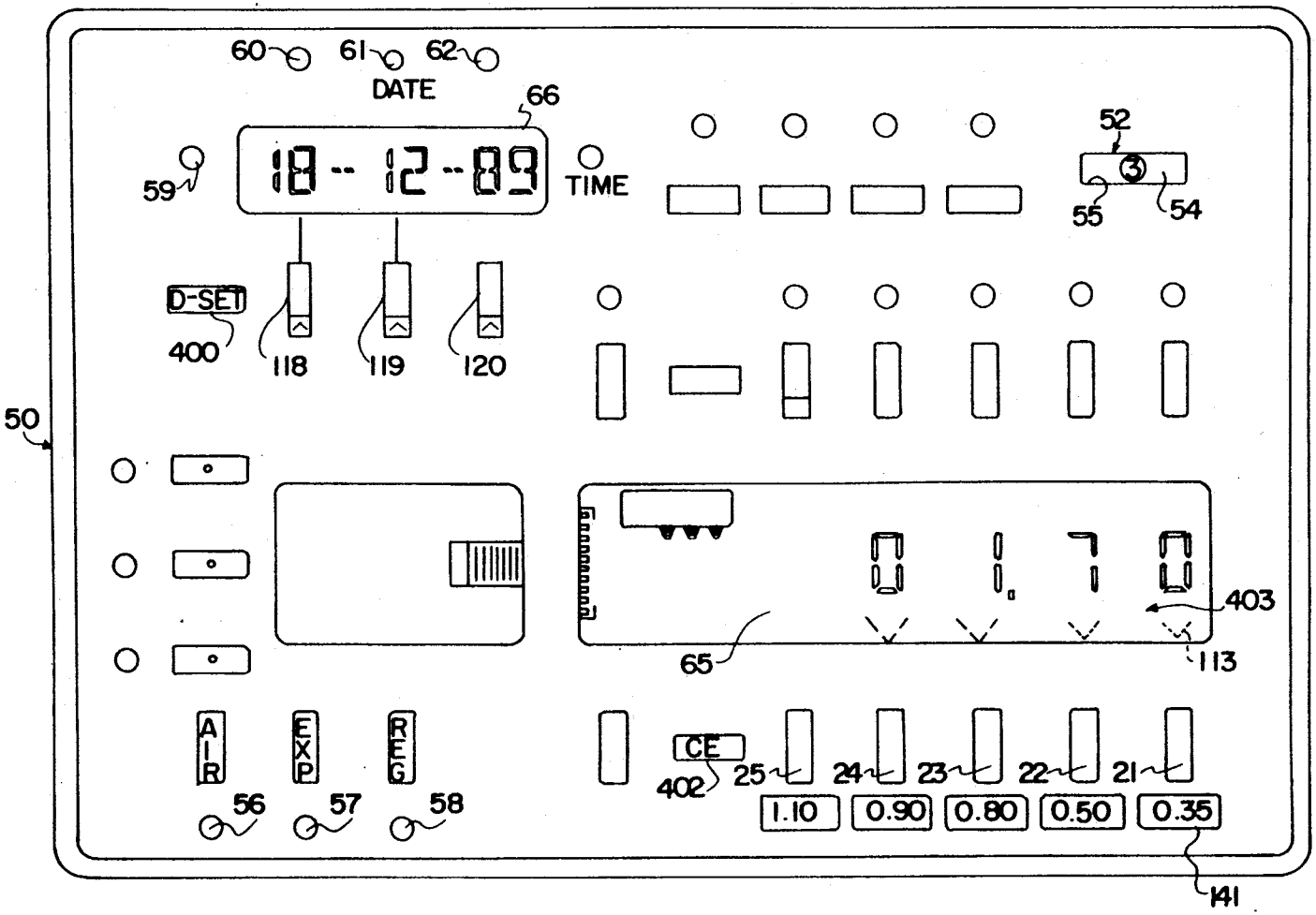
FIG. 5—A view of the control console of the franking machine.

For the additional securing of the setting positions succeeding one another in stepwise manner through the rod drive 4, 9 and for signalling to the central control unit (FIGS. 6 and 7) whether the setting by a complete position step has taken place, in accordance with FIGS. 1 and 4, the franking machine has a retaining pawl pair 29, 30 enveloping the machine mainshaft 6 and which, by the tension of a tension spring 31, is kept in engagement with a rectangular tooth system 32 of the racks 7. A solenoid 33 moves the retaining pawl pair 29, 30 via a transmission lever 34 against the tension of tension spring 31, so that said electromagnet 33 is supplied with current on each occasion just prior to the power supply to a drive magnet 9, 9' in order to temporarily release the engagement with the racks 7 for the shifting thereof into a new setting position. The back-indication of the position of the retaining pawl pair 29, 30 takes place by an optical sensor 35 located in the movement path of the transmission lever 34. If e.g. due to an excessively large operating resistance, during the setting displacement of racks 7 only an intermediate position is reached, in which the associated typewheel 2 does not have a clearly defined printing position, then at least one of the retaining pawls 29, 30 does not pass into a gap 32*a* of the rectangular tooth system 32 and the transmission lever 34 remains in an outer pivoted position, which by means of the sensor 35 is indicated to the central control unit (FIGS. 6 and 7) in the form of a fault signal.

The basic position of the machine mainshaft 6 is also monitored e.g. by a sensor 36, which is located in the movement path of a locking lever for the control wheel 39 fixed to the shaft 6. In FIG. 4 this locking lever 38 is covered by the transmission lever 34 having the same contour. In the basic position of the machine mainshaft 6, in which only the drive rods 4, 4' can engage with the associated rack 7, a hook part 40 of locking lever 38 is in engagement with a recess 41 of the control wheel. This engagement is not possible outside the basic position, so that sensor 36 indicates this to the central control unit via function field 96 (FIGS. 6 and 7). However, the monitoring of the rotation positions of the machine mainshaft can also take place by means of a perforated disk fixed thereto and sensors associated with said disk.

As can be gathered form the flowcharts for the programme sequence of the central control unit (FIGS. 6 and 7), the signals of the said sensors are required for controlling the franking value setting.

The basic electronic elements used in the block diagram of the central control unit will be briefly explained hereinafter, referencing FIGS. 6 and 7.

The entry of the random instructions by means of said value entry keys 21–25, AIR 56, EXP 57, REG 58, D-SET 400, CE 402, etc. takes place by means of the control console 50. An ENCODER 51 converts the key signals into binary word signals, which pass to a BUS-CONTROLLER and MULTIPLEXER 70. A key 52 is also connected via an ENCODER 53 to the latter and by means of five signals informs the control unit which user key 54 has been inserted in the key reception opening 55 on the control console 50, so that the consumed value quantities are added to the stored value quantity stock of the particular user.

This key is described in greater detail in U.S. Pat. No. 4,788,623. Moreover, as peripheral elements, the indicator lamps 56–62 of control console 50 and the display 65, 66 are connected via a decoder and a driver 67, 68 to the BUSCONTROLLER and MULTIPLEXER 70, so that, on the basis of information received as a binary word, they can be driven with the necessary electric power. A battery-operated clock 71 is also provided as a peripheral element for the automatic setting of the date on display 66, as well as on printing head 1.

The BUSCONTROLLER and MULTIPLEXER 70 periodically or spontaneously operates the peripheral elements 50, 52, 56–62, 65 and 66, separates the inputs and outputs and brings or reads the informations into sequential form to or from the peripheral bus 72. It can be constructed as a separate microprocessor.

Peripheral buses 72, 73 are connected to both ends of a central computer bus 74 across a bus isolator 75, 75' and a bus port 76, 77. The bus isolators 75 bring about a separation of the signals, so that no faults pass to the computer bus 74 and therefore to the master computer 80 (CPU). The bus port 76, 77 brings about a transfer of the signals from the rapid computer bus 74 to the slow peripheral bus 72, 73. The second peripheral bus leads to an INTERFACE CONTROLLER 78, which has a microcomputer system, in order to operate different, not shown interfaces. Such an interface is e.g. necessary in order to adapt the operation of the control unit and therefore the franking machine to those of an automatic letter supply means.

The correct function of the master computer 80 (CPU) is checked by an electronic "WATCH-DOG" unit 81, i.e. a computer and supply monitoring means. This restarts the master computer 80 if periodic control signals do not occur or if it attempts accesses to forbidden address areas. If the computer supply drops, it is switched off.

The "RELAY" unit 82 switches the supply of the electromotive drive of the machine mainshaft 6, the magnets 9, 9' of the rod drive 4, 4' and the solenoids 33 for moving the retaining pawls 29, 30 into the release position.

The drive 83 of the machine mainshaft 6 is connected by means of an OUTPUT PORT 84 and a DRIVER 85 to the computer bus 74. This output port 84 reads the information intended for this output at the correct moment from the computer bus 74 and stores this information. The driver 85 brings about a power amplification adapted to the drive 83. A further driver 86 is provided between the output port 84 and the solenoid 33' for the locking lever 38 of the machine mainshaft 6.

In the same way, the following magnet drives are controlled by the master computer (CPU 80) via an OUTPUT PORT 88–90 and associated driver 91–93: drive magnets 9, 9' for the drive rods 4, 4' of the franking value setting, not shown drive magnets 94 for corresponding, not shown drive rods according to FIGS. 1 to 4 of U.S. Pat. No. 4,520,725, which are used for the setting of the date typewheels of printing head 1 and a not shown retaining magnet 95 for a letter trip switch.

The retaining magnet 95 is activated if a letter trip switch provided on the franking table below the franking head 1 is operated by the striking of a letter to be franked. The retaining magnet 95 holds back the deflected switching contact of the letter trip switch, so that it cannot move the letter and so that the franking value impression takes place at the precisely predetermined point. It releases the trip switch as soon as the letter has left the release area.

In addition to information supplied via BUS CONTROLLER 70 and computer bus 74 to the master computer (CPU 80), further information is supplied from sensors of the franking machine mechanism via input ports 97, 98. These are the sensors 10, 11, 10', 11' according to FIG. 3 for indicating back a timing movement of the drive rods 4, 4' via the in-each-case raised detents 12, 12', the sensor 35 for the position of the retaining pawls 29, 30 moved during each timing movement of the drive rods 4, 4', in order to signal the exact setting position of the racks 7, the sensor 36, which signals the basic position of the machine mainshaft 6 or the printing head 1 necessary for value setting and the sensor 99 for the presence of a letter to be franked on the franking table.

A further INPUT PORT 100 (FIG. 7) is provided for the connection of the POWER SUPPLY MONITOR 101. The latter provides an early warning to the master computer (CPU 80) regarding an imminent supply voltage failure. With the aid of the energy stored in support capacitors it is possible to complete most functions of the control unit. No new functions are started in the warning state.

Finally, the central control unit according to FIGS. 6 and 7 has several memories, i.e. a PERMANENT MEMORY 103, which is a ROM, PROM or EPROM, a temporary memory 104, which stores the function data, a non-volatile memory 105, which is a RAM with battery, a NOVRAM, an EEPROM or an EAROM and stores the intermediate results of the programme sequence, as well as a removable permanent memory 106, which contains security codes required during the authorized loading of the value quantity memory. The latter can be a ROM, PROM, EPROM, EEPROM, EAROM, NOVRAM or RAM with battery.

Figure 8:
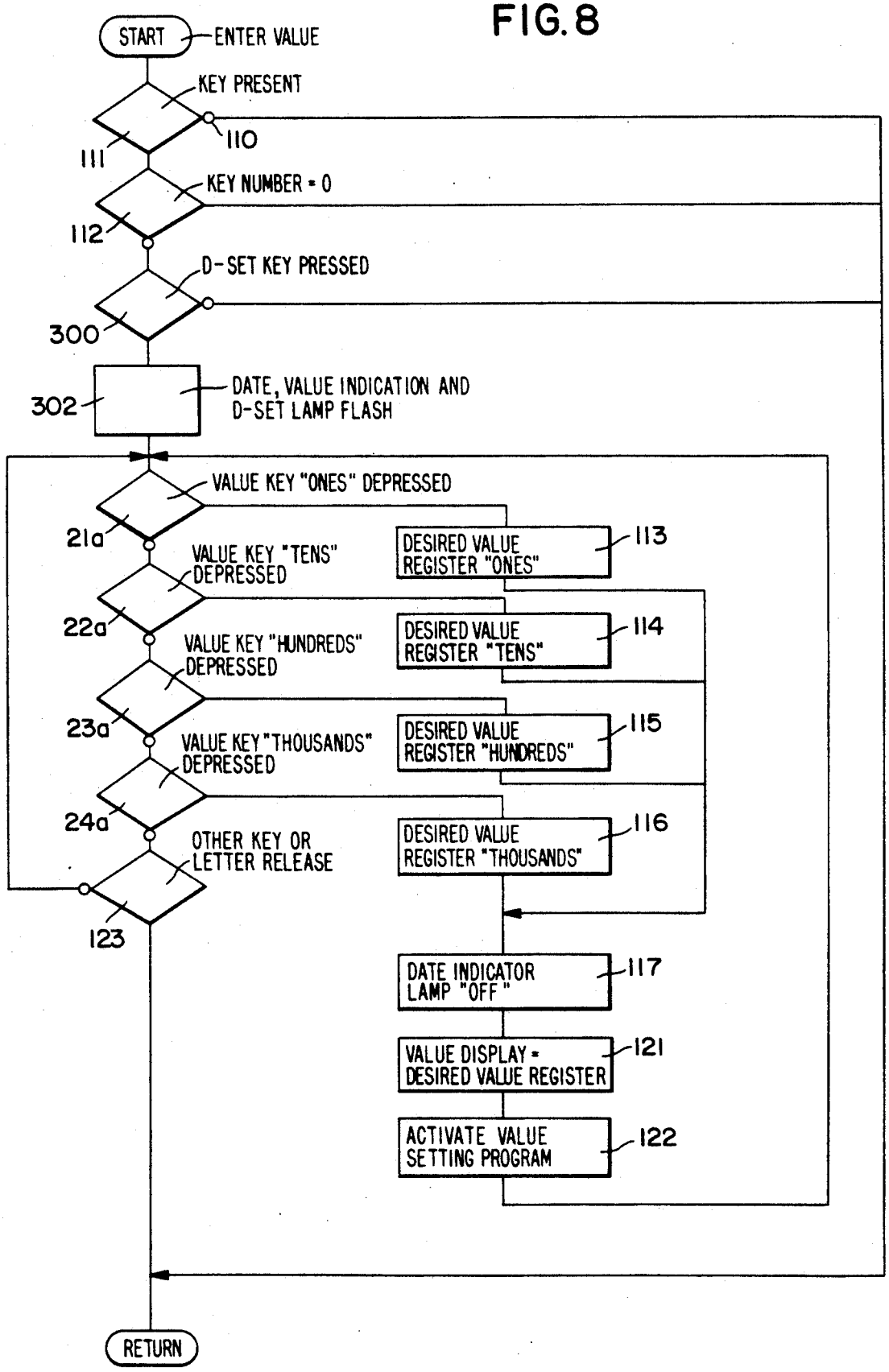
FIG. 8—A flowchart of a programme sequence of the electronic control unit in the case of a cyclic operation of the keys for entering a franking value.

FIG. 8 diagrammatically shows the sequence of instructions 21a–24a in the programme sequence during the cyclic entry of franking values via the keys 21–24 of the control console 50. The programme path over a junction 110 indicated by a circle in each case if the legend associated with the particular branch, e.g. 111 "key present", does not apply. A check takes place at the first two branches 111, 112, whether a correct user key 54 has been inserted in the key opening 55 of the control console 50. Key number 0 is only to be used if the register of the value quantity to be stored in the franking machine is to be loaded.

The diagram shows at function field 300, that for the timed value entry by means of keys 21–24, it is necessary to press the D-set key 400 beforehand. Subsequently there is flashing, according function field 302, of both of the indicator lamps 60–62 above the display 66 for the date and the decimal markings 403 on display 65 for the franking value entry. After pressing one of the value keys "ONES" 21, "TENS" 22, "HUNDREDS" 23 or "THOUSANDS" 24, the corresponding entry enters the associated desired value register corresponding to the particular decimal place, as shown by the function fields 113–116. The indicator lamps 60–62 are extinguished according to function field 117, because by operating a value key 21–24, in place of a date entry key 118–120, the decision to set a franking value was made. Each key pressing or entry clock advances the desired value register 113–116 of the corresponding decimal place by one digit, so that digits 0–9 can be entered.

According to function field 121, on display 65 appears the entered value and according to function field 122, the programme for the mechanical value setting is immediately activated on printing head 1, as shown in FIG. 9. The process is ended according to function field 123 if subsequently, e.g. through the operation of the letter trip switch, the functional sequence for franking impression is initiated.

In accordance with the programme sequence shown in FIG. 9 for the automatic value setting on printing head 1 of the franking machine, in accordance with function fields 125, 126, it is initially checked whether the machine mainshaft 6 has its basic position, in which the drive rods 4, 4' can engage with the racks 7 guided therein and whether e.g. there is no fault indication through sensor 35 of retaining pawls 29, 30. In accordance with the successive branches 127, 128, it is a prerequisite for the further value setting functional sequence, that the entered value quantity is not yet present in the actual value register and that a higher value quantity is present in the desired value register than in the actual value register. If this is not the case, in accordance with function field 129, magnets 9, 9', according to FIG. 2, are simultaneously activated, so that, in accordance with the preceding description, typewheels 2 for all the decimal places are reset to the position 0, so that the value setting to the value in the desired value register starts again from the beginning. The back-indication of this value cancellation takes place on branch 130 and for this purpose the sensors 10, 11, 10', 11' of detents 12, 12', 12'', 12''' are provided.

A check then takes place on branches 131, 132, 134 for each decimal place, i.e. the "ONES", the "TENS", the "HUNDREDS" and the "THOUSANDS", whether the desired value register content is higher than the actual value register content. In order to shorten the description the branch for the "HUNDREDS" and also the following fields for setting the "THOUSANDS" are not shown. If the desired value register content is higher, then in accordance with the following function field 135, 312 solenoid 33 is activated for releasing the retaining pawls 29, 30 and subsequently, according to function field 136, 313 the movement of drive rods 4, 4' is carried out by activating the particular rod drive magnet 9, 9' until a number of movement cycles corresponding to the difference of the values of both register contents has been carried out, so that the branch 131, 132, 134 frees the paths 137, 138. The back-indication of the value cancellation for each decimal place takes place on branch 310, 314, 315. At the end, a programme sequence for establishing faults in accordance with function field 140 is activated.

The entry process described by means of the flowcharts of FIGS. 8 and 9 is, however, only exceptionally used if no corresponding fixed value is associated with the entry keys 21–25 and the surcharge keys AIR, EXP, and REG by corresponding preprogramming.

FIG. 10 shows the programme sequence for associating fixed franking amount quantities with said entry keys. After association has taken place, the entry keys 21–25 are identified by their stickers 141 indicating the fixed value and which are either stuck on them or, in accordance with the embodiment shown in FIG. 5, alongside them. According to FIG. 5, in addition to the fixed values air, exp and reg, the fixed values 0.35, 0.50, 0.80, 0.90 and 1.10 are entered, which are the most frequently required franking machine values for individual users in Switzerland.

As in the case of the cyclic or incremental entry according to FIG. 8, wherein a check is made in accordance with branches 111, 112, in FIG. 10 a check is first carried out in branches 142, 143 to establish whether a key 54 acceptable for the programme has been inserted in control console 50. The association of a previously entered amount, e.g. in accordance with the indicated fixed values with one of the entry keys, takes place by a simultaneous pressing of the D-set key and the particular entry key 21–25, AIR, EXP, and REG, as indicated by the legend with respect to the branch fields 144–150. In the legend according to FIG. 10, the entry keys 21–25 are designated in accordance with their arrangement on the decimal places of the display 65. According to the function fields 151–158, subsequently the value register associated with said entry keys is brought to the actual value corresponding to the fixed value. At the end of fixed value storage, the display in display means 65 is at value 0000 according to step 320. The process is ended according to function field 322, e.g. through the operation of any other key or the letter trip switch.

Figure 11A:
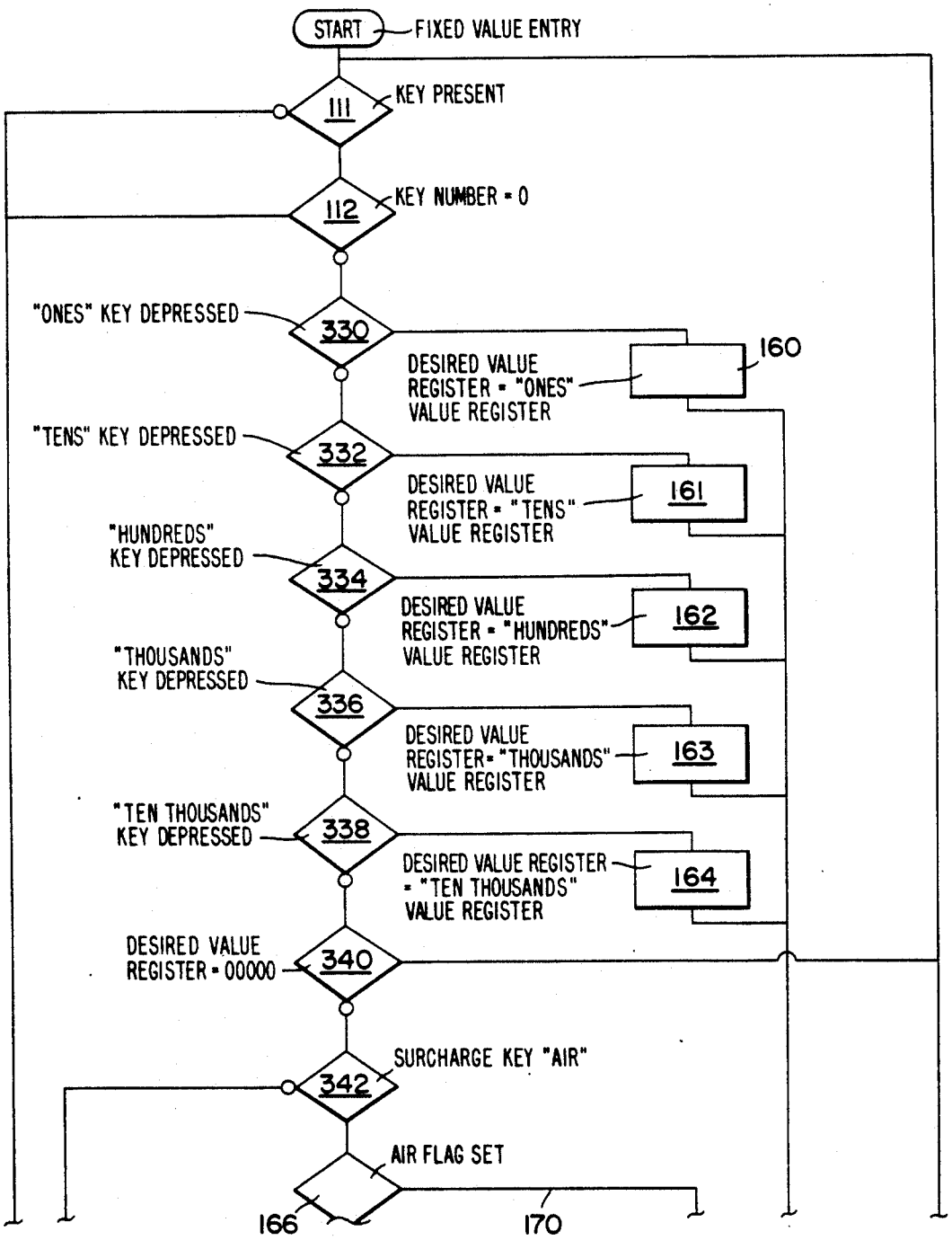
FIG. 11A—The upper part of the flowchart of a programme sequence in the case of franking value entry by means of keys for fixed, predetermined value amounts and by means of surcharge keys.
Figure 11B:
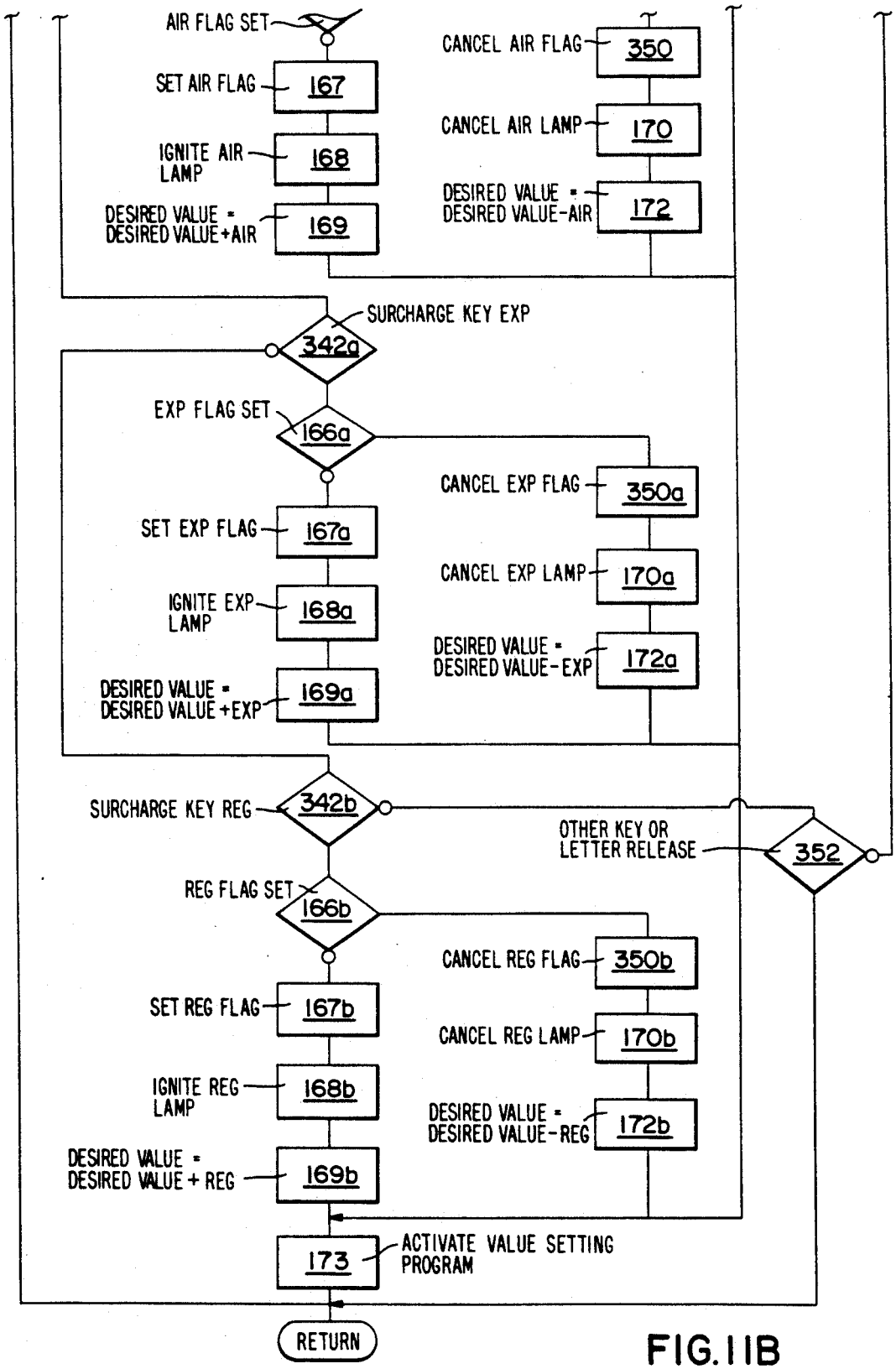
FIG. 11B—The lower part of the flowchart of FIG. 11A.

The programme sequence for the entry of franking values by means of the entry keys which have become fixed value keys is represented in the flowchart according to FIGS. 11A and 11B. In the upper part of the chart according to FIG. 11A, it can be gathered from the legend relative to function fields 160–164, that after pressing the five entry keys 21–25 arranged at decimal places of the display 65, at function fields 330–338, the desired value register is set to the fixed value 0.35, 0.50, etc. corresponding to the particular entry key.

In the following part of the chart the programme sequence is shown on pressing and further pressing of the surcharge keys air, exp and reg for the additionally required franking value amounts for airmail, express mail or registered mail. For example, if the desired value register is not 00000 as determined at function field 342, on pressing the surcharge key air as sensed at function field 340, a check is carried out on branch 166 to establish whether by setting an AIR FLAG the corresponding state has been signalled. If not, in accordance with function field 167 the AIR FLAG is set and in accordance with the subsequent function fields 168, 169 the indicator lamp 56 of the control console 50 is lit up and the air surcharge added to the desired value entered according to the upper chart part.

If on pressing the surcharge key AIR, the AIR FLAG is already set and the lamp 56 indicating the surcharge function is already lit up, then the AIR FLAG is cancelled at function field 350 and AIR indicator lamp 56 is extinguished at function 170, and according to function field 172 the air surcharge is deducted from the desired value already containing it. The programme takes place in the same way on operating the other surcharge keys EXP and REG, FIG. 11B showing similar function fields by numerals XXXa and XXXb. At the end of the programme sequence of fixed value entry, in accordance with function field 173 the value setting programme is activated and takes place in accordance with the flowchart of FIG. 9.

As is apparent from the uncaptioned further keys on the control console 50, with the aid of its control unit and further, not-described mechanical means, the franking machine can carry out several further functions, although there is no need to mention them as a result of the lack of any direct link with the present invention.

The drawings and the foregoing description are not intended to represent the only form of the invention in regard to the details of its construction and manner of operation. Changes in form and in the proportion of parts, as well of substitution of equivalents, are contemplated as circumstances may suggest or render expedient; and although specific terms have been employed, they are intended in a generic and descriptive sense only and not for the purpose of limitation, the scope of the invention being delineated in the following claims:

What is claimed is:

1. A franking machine comprising:

a printing head fixed to a machine mainshaft;

a drive for said machine mainshaft in order to rotate said printing head for at least one printing cycle;

typewheels mounted in rotary manner in said printing head for printing a franking value;

an electromechanical drive including control members for each of said typewheels for setting a desired franking value;

mechanical locking means for securing the set positions of said control members of said electromechanical drive;

a central electronic control unit including a memory in which is stored a postal rate table, and a program memory for automatically controlling the timing and operating functions of said electromechanical drive;

sensors for supplying position signals of said locking means to said central electronic control unit for the control of said electromechanical drive;

a control console comprising a keyboard, having an instruction key and a plurality of franking value entry keys, for the random inputting of instructions to said control unit for setting said typewheels of said printing head, and at least one display panel for the display of the inputted instructions; and wherein said central electronic control unit comprises:

means responsive to actuation of said franking value entry keys to provide a total franking value to be operatively coupled to said print head via said electromechanical drive;

means responsive to actuation of said instruction key for programming at least one of said entry keys, such that after programming, and upon actuation of, said one entry key, a programmed predetermined franking value amount is incrementally added to said total franking value; and means responsive to further actuation of said one entry key for incrementally deducting said programmed predetermined franking value amount from said total franking value; and wherein said control console comprises a number of said entry keys, corresponding to the decimal places of a maximum franking value amount, for the cyclic entry of individual franking value digits ("0"–"9") at each decimal place in a first entry mode and for the direct entry of said fixed, predetermined franking value amounts resulting from the programming by said control unit in a second entry mode, said instruction key being operative for switching between said two entry modes.

2. A franking machine according to claim 1, wherein said control unit supplies control instructions to said electromechanical drives before the complete franking value amount to be printed by said printing head has been entered via said keyboard.

3. A franking machine according to claim 1, wherein said keyboard includes at least one additional entry key for the direct entry of franking value amounts fixed and predetermined according to programming by said central electronic central unit.

4. A franking machine comprising:

a printing head fixed to a machine mainshaft;

a drive for said machine mainshaft in order to rotate said printing head for at least one printing cycle;

typewheels mounted in rotary manner in said printing head for printing a franking value;

an electromechanical drive including control members for each of said typewheels for setting a desired franking value;

mechanical locking means for securing the set position of said control members of said electromechanical drive;

a central electronic control unit including a memory in which is stored a postal rate table, and a program memory for automatically controlling the timing and operating functions said of electromechanical drive;

sensors for supplying position signals of said locking means to said central electronic control unit for the control of said electromechanical drive;

a control console comprising a keyboard, having an instruction key and a plurality of franking value entry keys, for the random inputting of instructions to said control unit for setting said typewheels of said printing head, and at least one display panel for the display of the inputted instructions; and wherein said central electronic control unit comprises:

means responsive to actuation of said franking value entry keys to provide a total franking value to be operatively coupled to said print head via said electromechanical drive;

means responsive to actuation of said instruction key for programming at least one of said entry keys, such that after programming, and upon actuation of, said one entry key, a programmed predetermined franking value amount is incrementally added to said total franking value; and means responsive to further actuation of said one entry key for incrementally deducting said programmed predetermined franking value amount from said total franking value; and wherein said entry keys, whose number corresponds to the number of decimal places of a maximum franking value amount, are in each case spatially associated with that part of said display of said control console on which appears the decimal place to be set by them during cyclic entry.

* * * * *